US006394671B1

(12) United States Patent
Jones et al.

(10) Patent No.: US 6,394,671 B1
(45) Date of Patent: May 28, 2002

(54) AUTO-MECHANISM FOR REMOVING FILM LEADER CARD FROM 35 AND APS FILM AFTER PROCESSING

(75) Inventors: Robert S. Jones; Daniel R. Rose, both of Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/687,701

(22) Filed: Oct. 13, 2000

(51) Int. Cl.[7] ..... G03D 13/10

(52) U.S. Cl. ..... 396/647; 396/652; 242/332.4

(58) Field of Search ..... 396/612, 617, 396/620, 621, 628, 647, 651, 652; 242/332, 332.4

(56) References Cited

U.S. PATENT DOCUMENTS

| | | | | |
|---|---|---|---|---|
| 5,376,986 A | | 12/1994 | Long | 354/321 |
| 5,381,204 A | | 1/1995 | Grusetski et al. | 354/345 |
| 5,463,441 A | | 10/1995 | Yamaguchi | 354/321 |
| 5,475,463 A | * | 12/1995 | Yamaguchi et al. | 396/652 |
| 5,608,487 A | | 3/1997 | Pierce et al. | 396/564 |
| 5,652,941 A | | 7/1997 | Arimoto et al. | 396/652 |
| 5,779,185 A | | 7/1998 | Masuda et al. | 242/556 |
| 5,781,812 A | | 7/1998 | Masuda et al. | 396/411 |
| 5,839,012 A | | 11/1998 | Miyai | 396/647 |
| 6,030,131 A | | 2/2000 | Shimamura et al. | 396/599 |

FOREIGN PATENT DOCUMENTS

| | | | |
|---|---|---|---|
| EP | 0 646 843 B1 | 12/1998 | G03D/13/00 |

* cited by examiner

*Primary Examiner*—David M. Gray
(74) *Attorney, Agent, or Firm*—David M. Woods

(57) ABSTRACT

Apparatus for removing a film strip from a film leader card includes (a) a feed section for holding the film leader card stationary in a first predetermined position with the film strip attached via protrusions to a film clip, said feed section having an entry port through which the film leader card is fully inserted in a forward direction with the film strip extending in a backward direction outward through the entry port; (b) means for forming a loop in the film that is folded underneath the film leader card in order to rotate the end of the film strip away from the film clip on the opposite side of the film leader card, thereby causing the film strip to de-tension from the protrusions; (c) a pinch roller assembly; (d) a detach mechanism for engaging the loop and extending it further under the film leader card toward, but not contacting, the pinch roller assembly, said detach mechanism including cams for further rotating the film strip until it is completely inverted and oriented in the forward direction, said cams holding the end of the film strip in place against the film leader card; (e) means for driving the film leader card in the backward direction toward the entry port until the film strip extends further through the film clip, at which point the film leader card is locked into a second predetermined stationary position; (f) means for further rotating said detach mechanism until the film strip is immovably engaged with the pinch roller assembly; (g) means for driving the film leader card forward away from the entry port until the film strip is disengaged from the film clip; and (h) means for releasing the detach assembly from the pinch roller assembly so that the film strip may be removed from the film leader card through the entry port.

6 Claims, 12 Drawing Sheets

AUTO-MECHANISM FOR REMOVING FILM LEADER CARD FROM 35 AND APS FILM AFTER PROCESSING

FIELD OF THE INVENTION

The present invention relates to use of a leader in automatically developing photographic films, and more specifically to a decoupling means for automatically decoupling such a leader from a film to which it is attached.

BACKGROUND OF THE INVENTION

After a customer has exposed a roll of photographic film, the customer takes the film to a photofinisher to obtain photographs of the images captured on the film. In order to develop the film, the photofinisher passes the filmstrip through a series of liquid baths that typically include a developer, a bleach/fix and a stabilizer. The film is then dried and used to create photographs or digital images.

One method of passing the film through the various baths is to attach a leader card to the lead end of the film and pull the leader card through the baths. The leader is a flexible synthetic resin sheet formed with a plurality of equally spaced holes arranged in a feed direction. The holes are adapted to engage a leader feed sprocket provided in the film developing unit. As the leader card is pulled through the baths, the film is towed behind the leader card and is therefor exposed to the baths.

If a film should separate from the leader and sink into a developing tank filled with developing solution, the film has to be taken out of the tank, which interrupts the developing operation. This work is troublesome and time-consuming. Also, there is the possibility that the film might be inadvertently exposed to light while taking it out of the developing tank. In order to prevent such an accident, every film has to be securely connected to a leader.

Various methods are used to attach the filmstrip to a leader card. Tape is commonly used to hold the filmstrip to the leader card But splicing tapes are difficult to handle because they have to be applied to the films and the leader while placing them on a special workbench to couple them together with high accuracy. Moreover, it is troublesome to detach the tapes from the films and the leader after developing films. The use of such tapes is also disadvantageous from an economical viewpoint because they are not reusable.

Filmstrips attached to a leader card with tape are removed by cutting the end of the filmstrip closest to the leader card and peeling the tape off the card and filmstrip. This process is messy but doable for manual handling. If the process is automated, the cutting action is clean but removal of the tape is complicated. U.S. Pat. No. 5,608,487 discloses a method to remove leftover tape from a leader card, but removing the tape from the film without damaging the film is difficult.

Some leader cards use tabs or tongues to clip the filmstrip on to itself, eliminating the use of tape. An example of a leader card that uses a tab type clipping method is disclosed in U.S. Pat. Nos. 5,652,941; 5,376,986; 5,381,204; and 5,463,411. FIGS. 34–37 show an example of the leader card described in the '941 patent, which provides a coupling structure capable of coupling films to a leader with high reliability. As shown, a leader 1 includes a flexible leader body formed of a synthetic resin sheet. It is formed with a plurality of holes 2 arranged along a feed direction at equal intervals. The leader 1 is fed in one direction by engaging a sprocket (not shown) in the holes 2 and rotating the sprocket.

The leader body has holes 4 in the rear portion thereof on both sides of the holes 2. A film 3 can be inserted in each hole 4.

The holes 4 have a width substantially equal to the width of film 3. By inserting the films 3 into holes 4, both edges of the films 3 abut both sides of the holes 4. Clips 5 are superimposed on the leader body 1 to cover the respective holes 4. The clips 5 are fastened to the leader 1 by bonding or fusing. Each clip member 5 has a window 6 that registers with the hole 4. Resilient protrusions 7 are formed on the front edge (with respect to the feed direction of the leader) of each window 6. The protrusions 7 extend across the holes 4 along the feed direction of the leader 1 so that their free ends are supported on the leader body near the rear edges of the holes 4.

The leading end of each film 3 is provided with holes 9. The protrusions 7 are adapted to engage in the holes 9, respectively. In order to connect the films 3 to the leader 1 accurately with little possibility of the films 3 inclining relative to the leader 1, each film 3 should have more than one hole 9 to receive a plurality of protrusions 7. By inserting the leading end of each film 3 into the hole 4 and the window 6, the protrusions 7 are deflected upwardly by being pushed by the leading end of the film 3 as shown in FIG. 36.

When each film 3 is inserted until its holes 9 face or oppose the protrusions 7, the protrusions 7 will be urged into the holes 9 due to their own resilient restoring force. By pulling back the film 3 in this state, the protrusions 7 are allowed to return to their original rest positions. The film 3 is thus coupled to the leader 1 as shown in FIG. 35. In the above manner, each film 3 can be automatically coupled to the leader 1 by pushing each film into the respective hole 4 by a predetermined distance and then pulling the film back. Once coupled to the leader 1, the films 3 are rigidly connected to the leader 1 with the free ends of the protrusions 7 supported on the rear edges of the holes 4 so that they will not be deflected downwardly. The films 3 are then fed, guided by the leader 1, into the film developing unit for development.

To detach films 3 from the leader after development, the films 3 are pushed forward, typically by hand, to raise the protrusions 7 until they completely disengage from the holes 9, and then the films are pulled back. In their rest positions, the protrusions 7, formed integrally with the clip members 5, are flush with the top surfaces of the clip members 5 fastened to the leader body 1. Thus, the protrusions 7 are less likely to be deformed by being caught by e.g. fingertips than protrusions directly fastened to the leader body 1. Nonetheless, hand removal is an inexact process that can lead to reliability problems in actual operation. Moreover, even though removing a filmstrip from a leader card with tabs is easier both manually and automatically, depending on the method used, damage to the end of the film and breakage of the leader card tabs occur.

SUMMARY OF THE INVENTION

An object of this invention is to provide a decoupling means for decoupling a film from a leader, which enables the film to be disconnected from the leader easily, reliably and automatically.

The present invention is directed to overcoming one or more of the problems set forth above. Briefly summarized, according to one aspect of the present invention, apparatus for removing a film strip from a film leader card includes (a) a feed section for holding the film leader card stationary in a first predetermined position with the film strip attached via protrusions to a film clip, said feed section having an entry port through which the film leader card is fully inserted in a forward direction with the film strip extending in a backward direction outward through the entry port; (b) means for forming a loop in the film that is folded underneath the film leader card in order to rotate the end of the film strip away from the film clip on the opposite side of the film leader card, thereby causing the film strip to de-tension from the protrusions; (c) a pinch roller assembly; (d) a detach mechanism for engaging the loop and extending it further under the film leader card toward, but not contacting, the pinch roller assembly, said detach mechanism including cams for further rotating the film strip until it is completely inverted and oriented in the forward direction, said cams holding the end of the film strip in place against the film leader card; (e) means for driving the film leader card in the backward direction toward the entry port until the film strip extends further through the film clip, at which point the film leader card is locked into a second predetermined stationary position; (f) means for further rotating said detach mechanism until the film strip is immovably engaged with the pinch roller assembly; (g) means for driving the film leader card forward away from the entry port until the film strip is disengaged from the film clip; and (h) means for releasing the detach assembly from the pinch roller assembly so that the film strip may be removed from the film leader card through the entry port.

A mechanism is thus provided which removes a filmstrip from a leader card. This eliminates the operator from the task and provides an automatic means to prepare the filmstrip for feeding into another process such as digital scanning. The leader card tab is configured to accept either 35 or 24 mm filmstrips, thus eliminating the need for two different cards. The removal method does not damage the film or leader card. The removal mechanism described is for removing two filmstrips from a single leader card. The same principle can be used to remove a single filmstrip from a leader card, as well as a single filmstrip from a narrow (single lane) leader card. The claims are intended to cover variations and modifications of the invention, including its application to single filmstrips as well as to multiple filmstrips.

The technical advantage of this invention is that it provides a decoupling means that enables a film to be disconnected from a leader easily, reliably and automatically.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE INVENTION

Because photofinishing equipment employing film leader transport mechanisms are well known, the present description will be directed in particular to elements forming part of, or cooperating more directly with, apparatus in accordance with the present invention. Elements not specifically shown or described herein may be selected from those known in the art.

Figure 1:
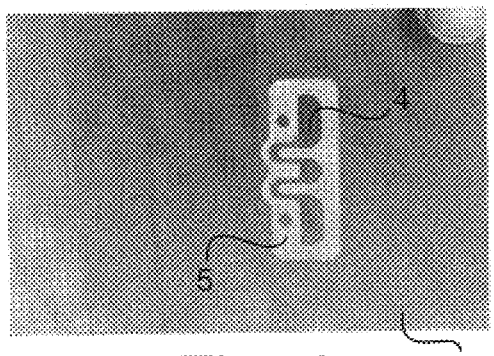
FIG. 1 is a close up view of a leader card attachment tab.
Figure 4:
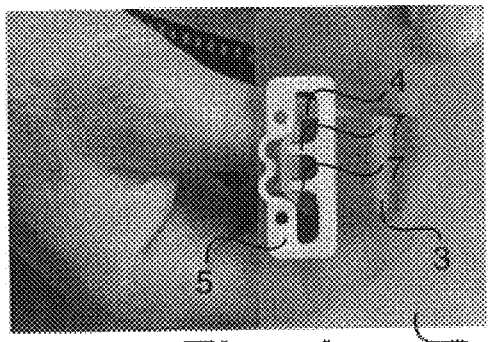
FIGS. 4, 5 and 6 show a sequence of film removal, including the film flipped (FIG. 4), the film pushed and released (FIG. 5) and the film sliding out of the tab (FIG. 6).
Figure 2:
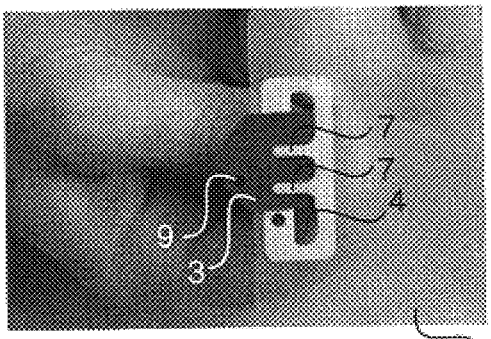
FIG. 2 shows the insertion of a film by hand onto the leader card attachment tab.
Figure 5:
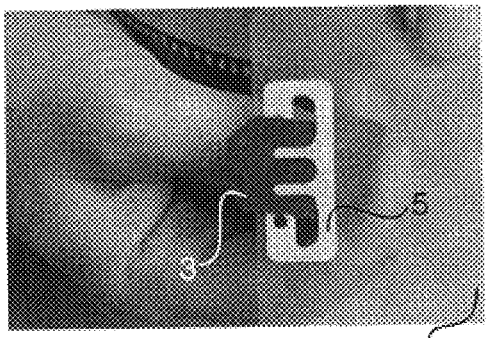
Figure 3:
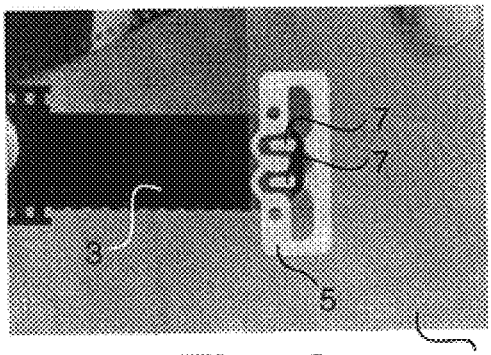
FIG. 3 is a close up view of the film connected to the leader card.
Figure 6:
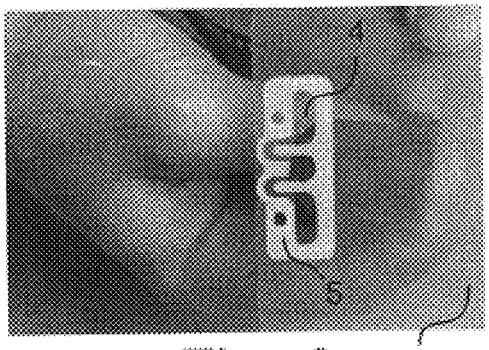

Beginning with FIGS. 1–6, it is instructive to understand how a film is attached and detached from a leader card by hand. FIG. 1 shows the clip member 5 superimposed on the leader body 1 and registered with the hole 4. FIG. 2 shows the hand insertion of the film 3 through the hole 4, and FIG. 3 shows the attachment of holes 9 of the film 3 to the protrusions 7 such that the film 3 is held in place on the leader body 1. Detachment of the leader body 1 is begun in FIG. 4 by reversing the direction of the film 3 such that the holes 9 in the film 3 are released from the protrusions 7. Then, in FIG. 5 the holes in the film 3 are freed from the protrusions, thereby enabling the film 3 to be freed from the clip member 5 such that it can be removed through the hole 4 (as shown in FIG. 6).

Figure 7:
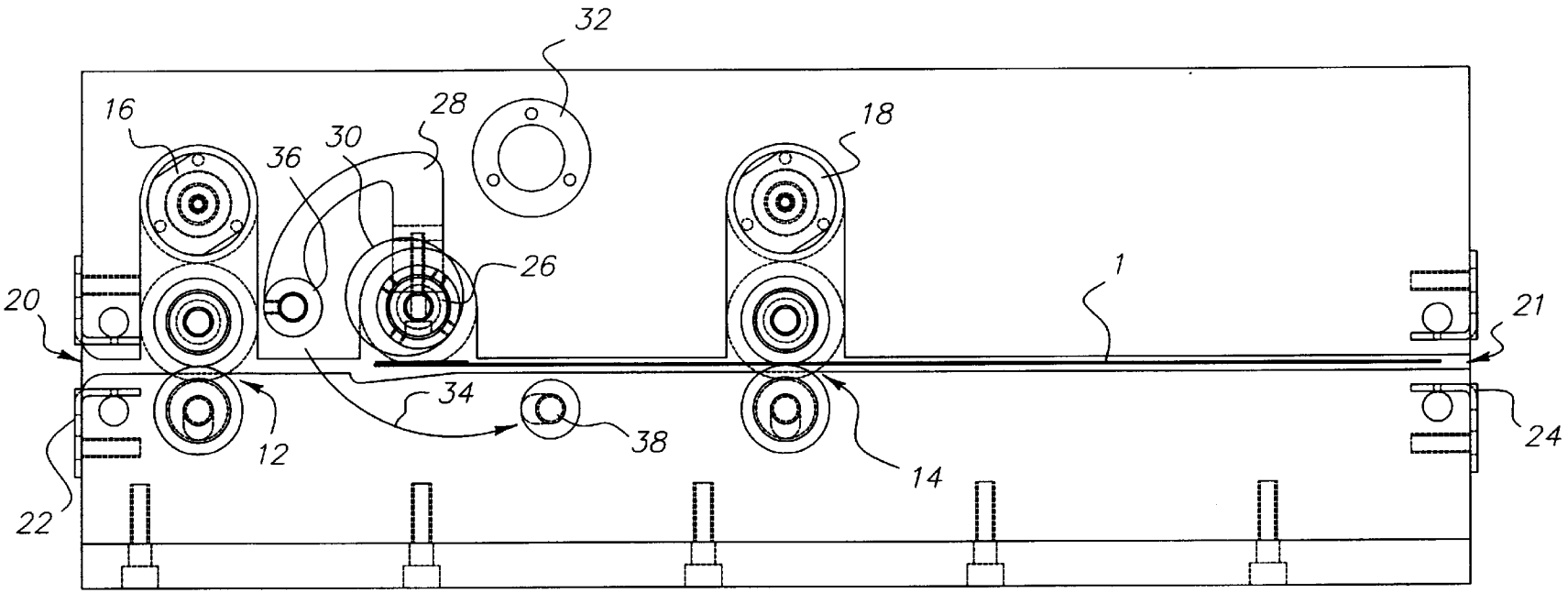
FIG. 7 is a side view of a detach mechanism in accordance with the invention.
Figure 8:
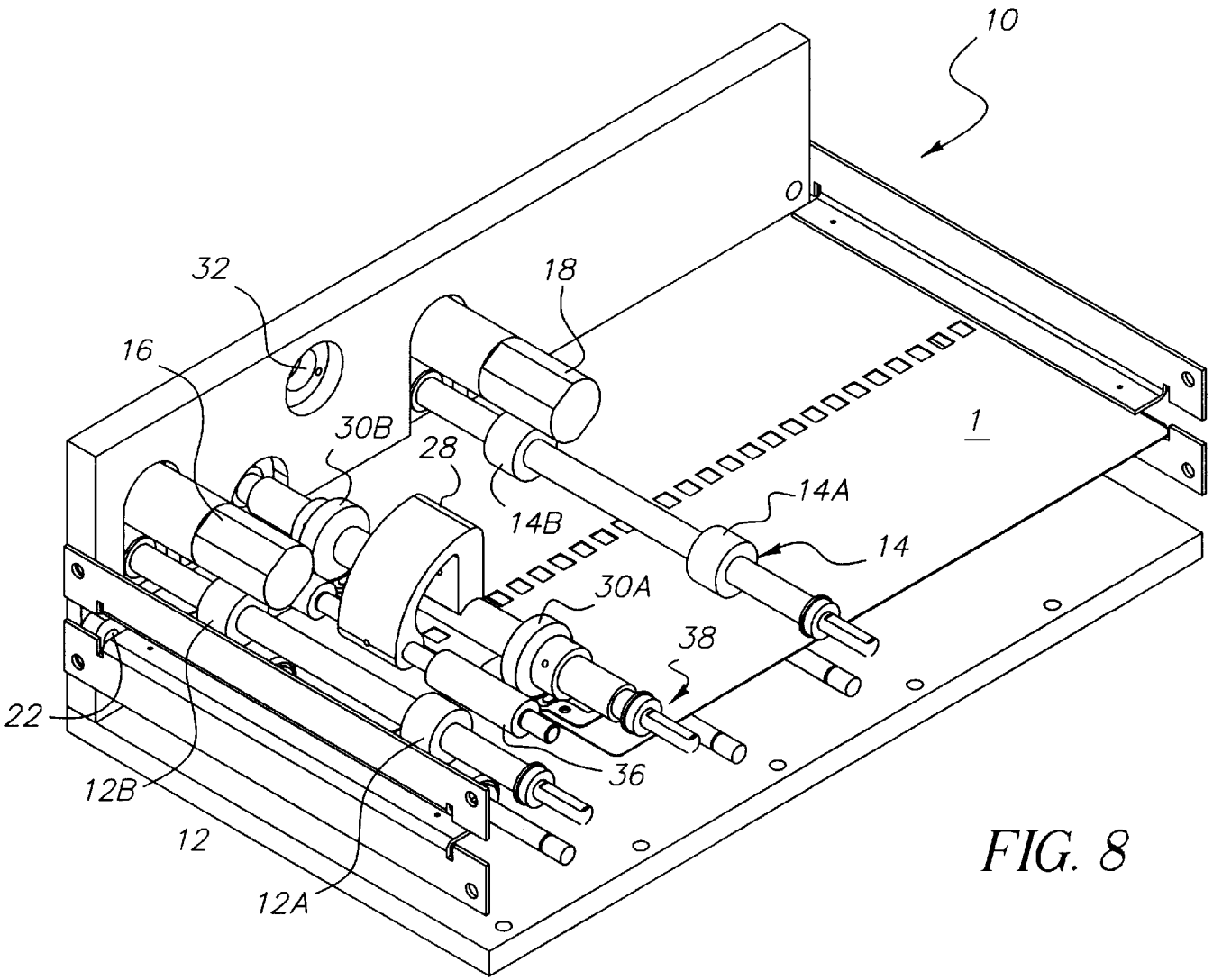
FIG. 8 is a front isometric view of the detach mechanism shown in FIG. 7.
Figure 9:
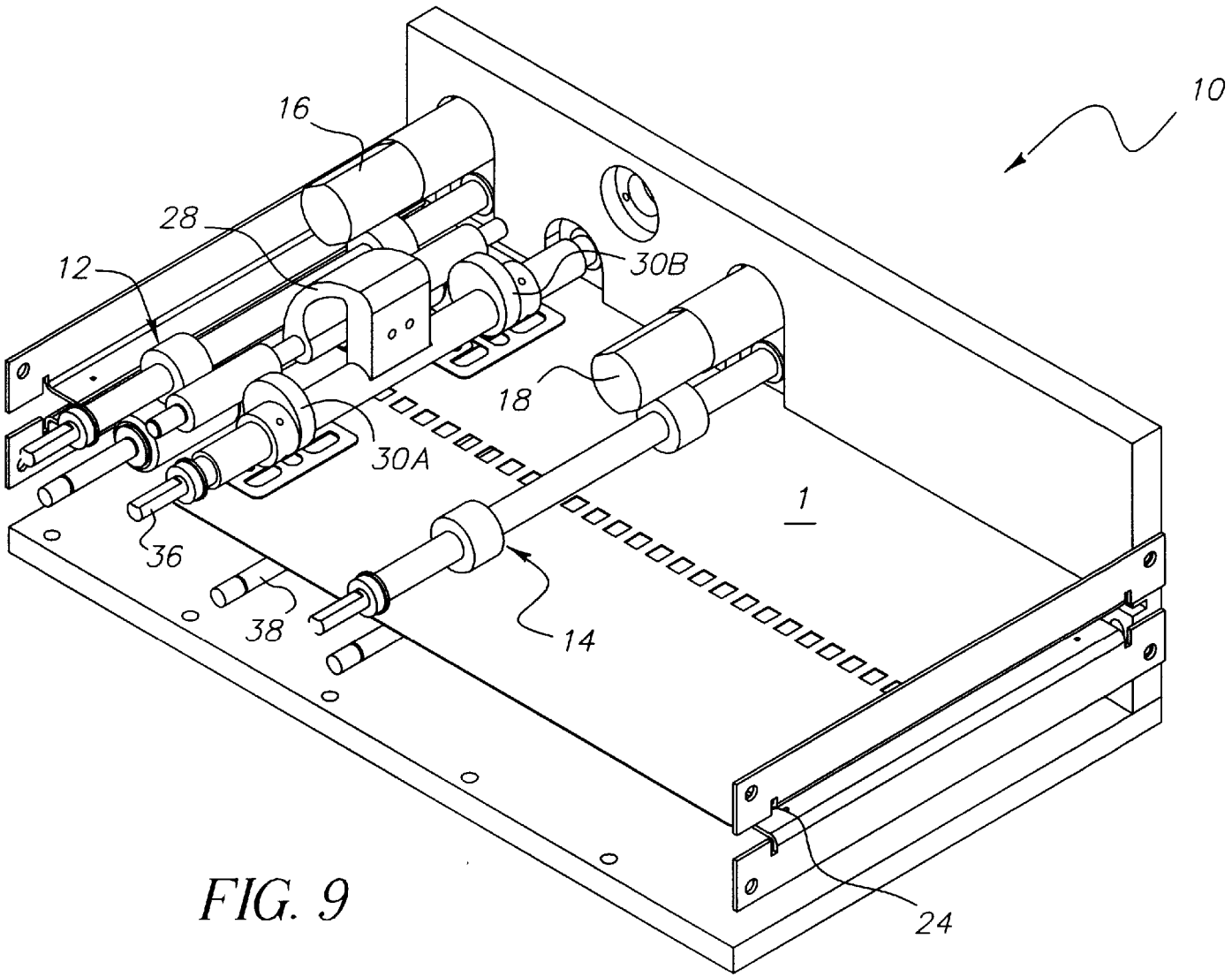
FIG. 9 is a back isometric view of detach mechanism shown in FIG. 7.
Figure 10:
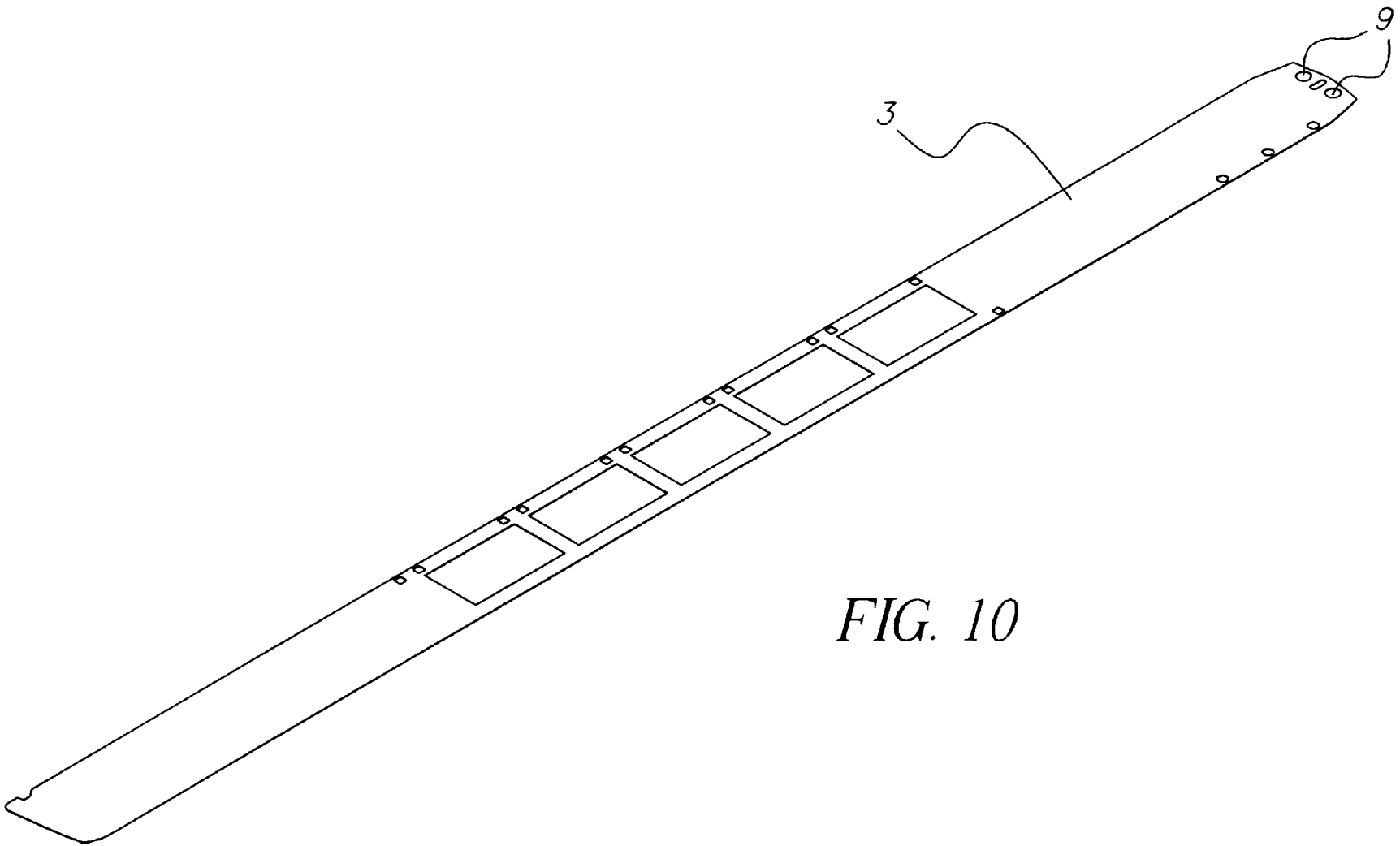
FIG. 10 is an isometric view of APS film.
Figure 11:
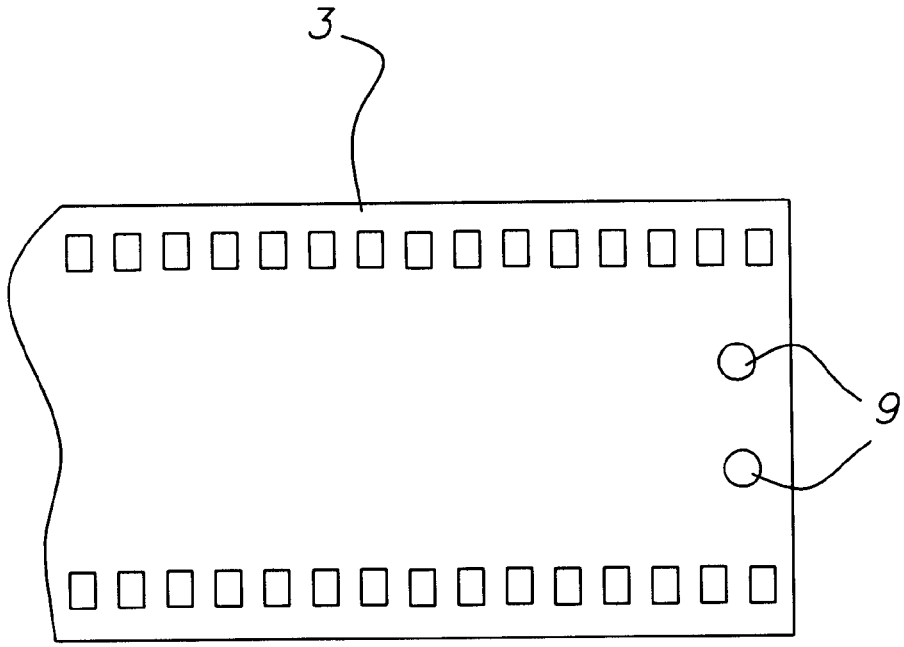
FIG. 11 is a top view of 35 mm film with punched holes.
Figure 35:
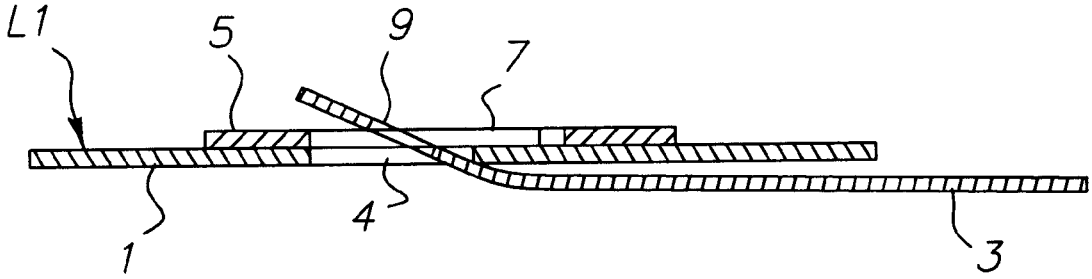
FIG. 35 is a sectional view taken along line II—II of FIG. 34.

Several views of the detach mechanism are shown in FIGS. 7, 8 and 9. The detach mechanism 10 includes a roller assembly 12 and a roller assembly 14 for supporting the film 3 and the leader card 1, respectively, at various stages of their travel along a transport path through the mechanism. Each roller assembly comprises a pair of opposed rollers for engaging the card 1 and/or the film 3 within their nip. The roller assembly 12 is driven by a motor 16, and the roller assembly 14 is driven by a motor 18. The leader card 1 enters the mechanism 10 through an entry port 20 and first passes a sensor assembly 22 at the entry port area and later a sensor assembly 24 at the opposite side of the mechanism 10 when the leader card 1 is completely inserted. When the detach process is finished, the leader card 1 exits through an exit port 21 on the opposite side of the detach mechanism 10. In the meantime, the leader card 1 is first captured by the roller assembly 12, and then the roller assembly 14. The signals from the sensor assemblies 22 and 24 are used to sequence and control the various parts and stages of the detach mechanism 10, including the roller assemblies 12 and 14.

Juxtaposed between the roller assemblies 12 and 14 is a detach assembly 26 including a detach arm 28 and a cam 30. The detach assembly 26 is driven by a motor 32 such that motion of the detach arm 28 generally describes an arc 34. The detach arm 28 includes a detach assembly roller 36, which at the furthest extension of the detach arm 28 about the arc 34, contacts a pinch roller assembly 38. When the detach arm 28 is moved through the arc 34, its roller 36 contacts the film 3 and forms a loop in the film, as best shown in FIGS. 28–33. Furthermore, during this arcuate motion the function of the cam 30 is to hold the film in place at certain critical points in the process of detachment, as will be explained in detail with reference to FIGS. 28–33.

Figure 12:
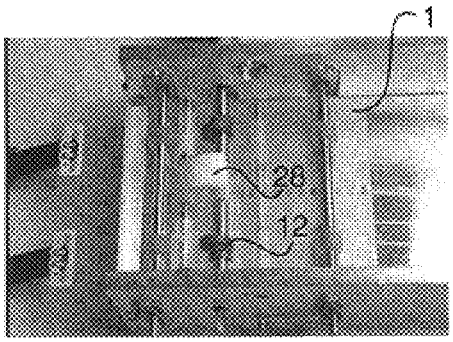
FIGS. 12–19 show a full view of the film detach process.

As shown in FIGS. 8 and 9, and further in e.g., FIG. 12, the detach mechanism 10 is capable of handling two filmstrips at once. For this reason, the roller assemblies 12 and 14 comprise two roller parts 12A and 12B, and 14A and 14B, for engaging the separate filmstrips. Likewise, the detach assembly roller 36 includes two roller parts 36A and 36B. The detach arm 28 is positioned so that it moves between the two filmstrips when it traverses the arc 34, while its roller parts 36A and 36B engage the respective films and form loops therein. Furthermore, two cam parts 30A and 30B are provided for engaging the separate filmstrips.

The operation of the detach mechanism may be understood by reference to the perspective views in FIGS. 12–27, and the side views of the detach arm shown in FIGS. 28–33. The general operational procedure is as follows:

The detach arm 28 in the detach unit starts out positioned perpendicular to the leader card 1.

The front edge of the leader card 1 enters the film detach unit 10 through the entry port 20 where it is seen by sensor 22, and roller assembly 12 begins to drive the card (see FIG. 12).

Figure 13:
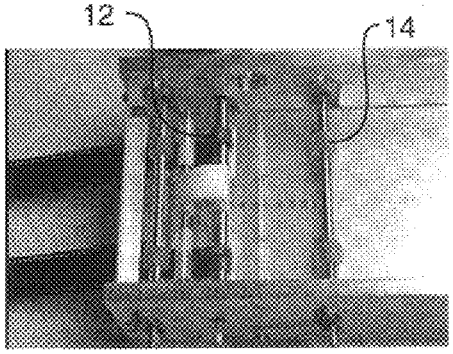

The leader card 1 continues to move until it reaches sensor 24, where it comes to a complete stop (see FIG. 13).

At this point, the card is held in place by roller assembly 14. This assembly is locked in place by motor 18, so that the card 1 cannot move. As also shown in FIG. 13, the roller assembly 12 has now engaged the films 3.

Figure 28:
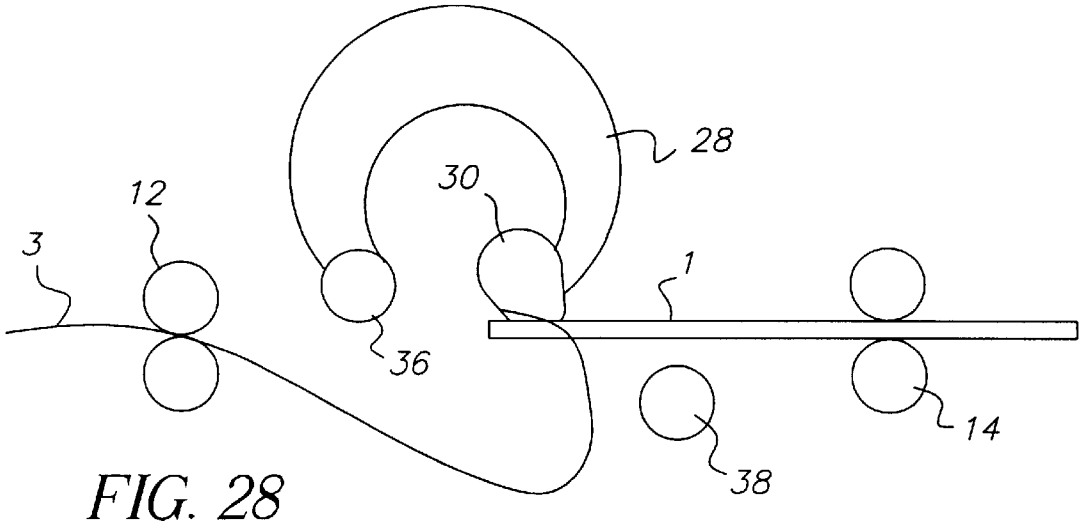
FIGS. 28–33 show side views of the operation of the detach assembly portion of the detach mechanism shown in FIG. 7.

At this point, roller assembly 12 begins to drive the films in by making two full revolutions, creating a sag (loop) in the respective films (see FIG. 28).

Figure 14:
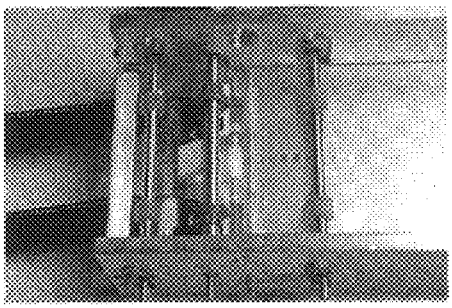
Figure 29:
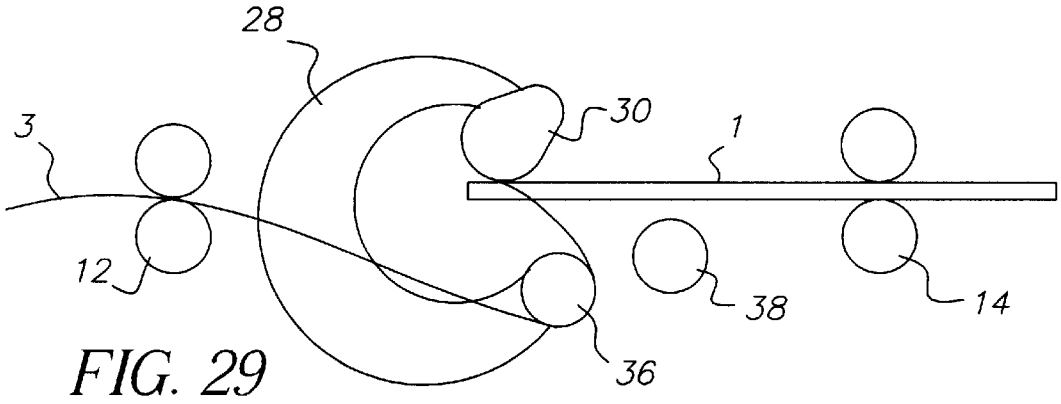

Motor 32 drives the detach arm 28 until it makes a rotation of 125 degrees (see FIGS. 14 and 29).

During rotation, the detach rollers 36A and 36B take the films 3 and fold them under the card 1 to form loops, while at the same time the two cams 30A and 30B on the detach shaft rotate to hold the trailing ends of the films 3 in place (see FIGS. 14 and 29).

Figure 30:
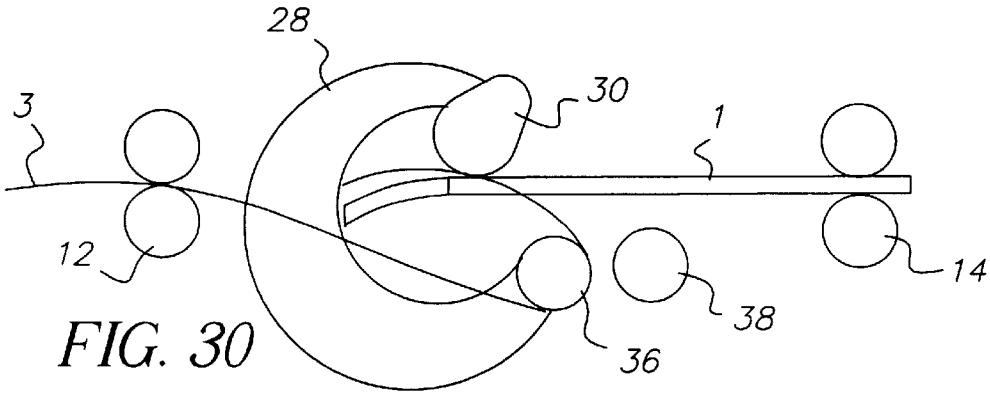

At this point the detach rollers 36A and 36B come just short of contact with the pinch roller assembly 38 (see FIG. 30).

Figure 15:
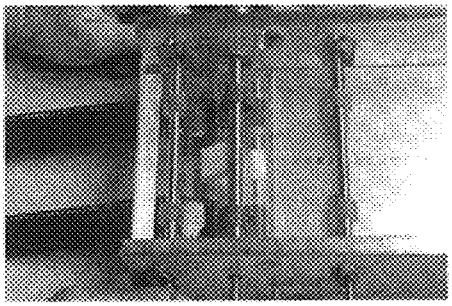

Now roller assembly 14 drives the card 1 backwards ⅜" and stops to lock the card in place, while roller assembly 12 remains locked to prevent film motion (see FIG. 15 and 30).

Figure 16:
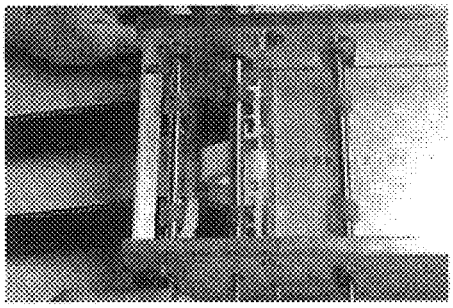
Figure 31:
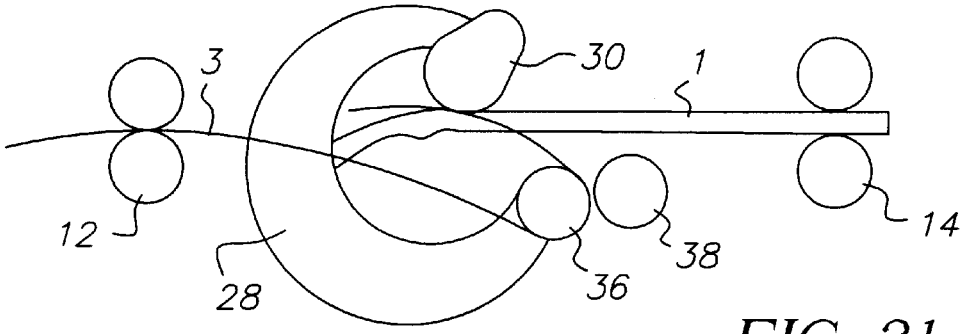

Once the card 1 has been repositioned, motor 32 rotates until the detach rollers 36A and 36B come into contact with the pinch roller assembly 38, with an applied torque (see FIGS. 16 and 31).

After this torque has been reached, the films 3 should be firmly pinched between the detach rollers 36A and 36B and the pinch roller assembly 38 so that there is no film strip movement.

Figure 17:
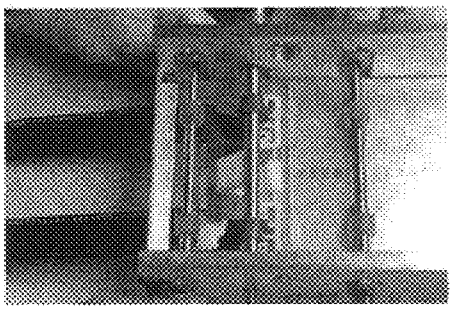
Figure 32:
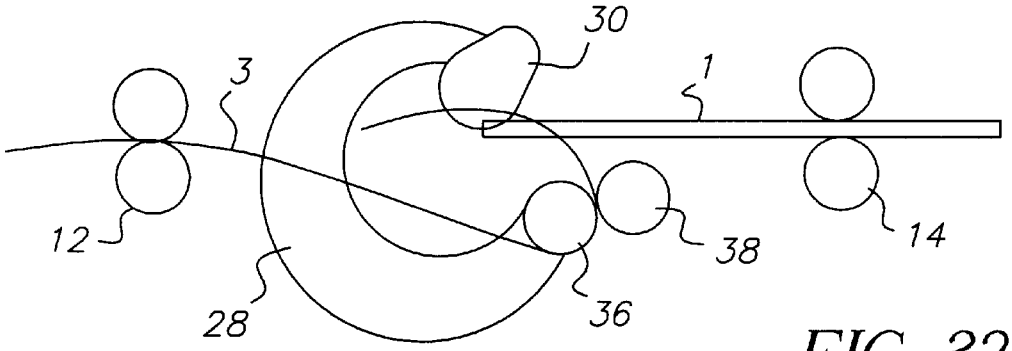

Now roller assembly 14 begins to drive the card 1 out of the detach unit 10 (away from the detach arm 28), until it has gone a linear distance of ¾", and comes to a stop once again and hold the card in place (see FIGS. 17 and 32).

After driving the card 1 forward, the end of the film 3 has been freed from the film clip protrusions 7, and is held in place under the cams 30A and 30B.

Figure 18:
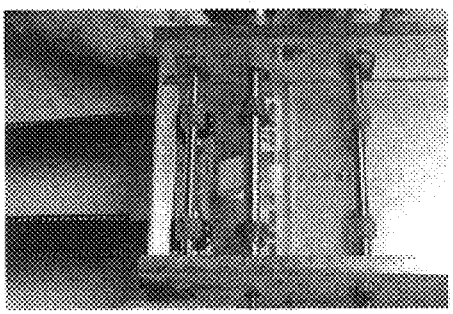
Figure 33:
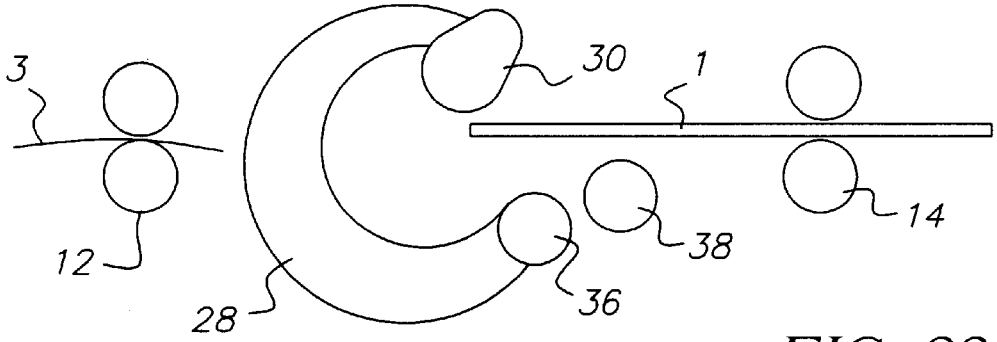
Figure 34:
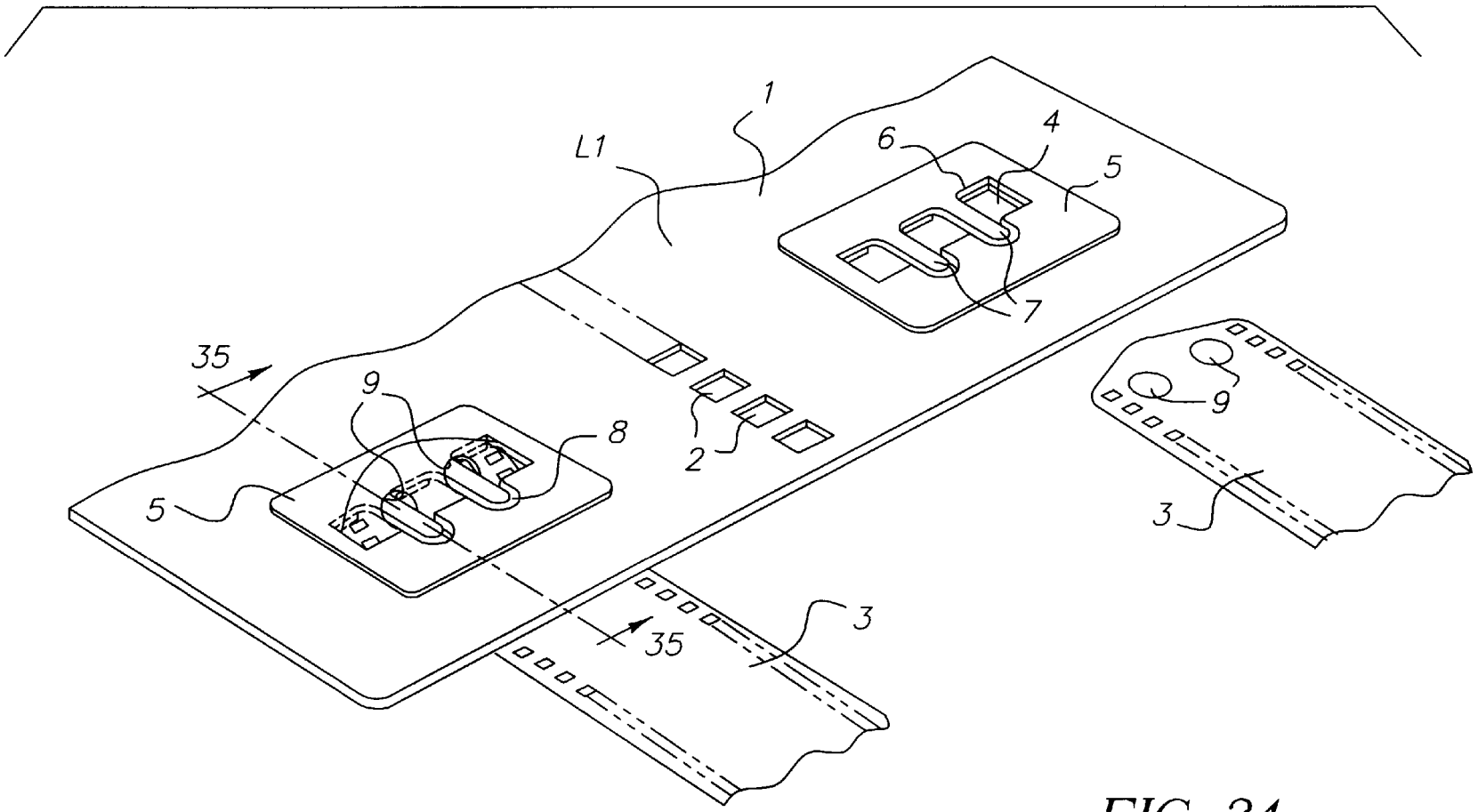
FIG. 34 is a perspective view of a known leader card.
Figure 36:
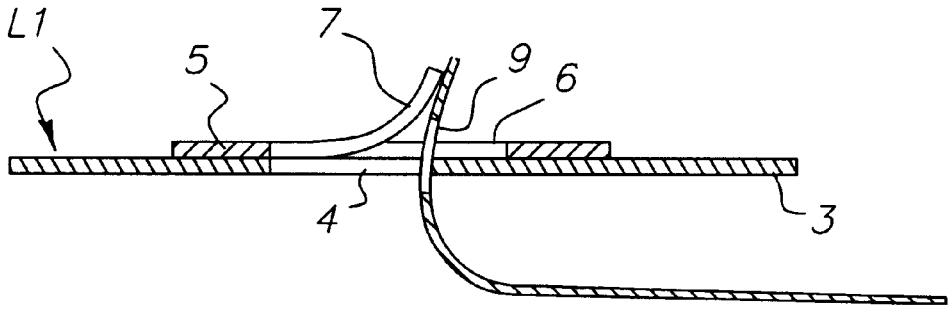
FIG. 36 is a sectional view showing an intermediate state of a film connecting step.
Figure 37:
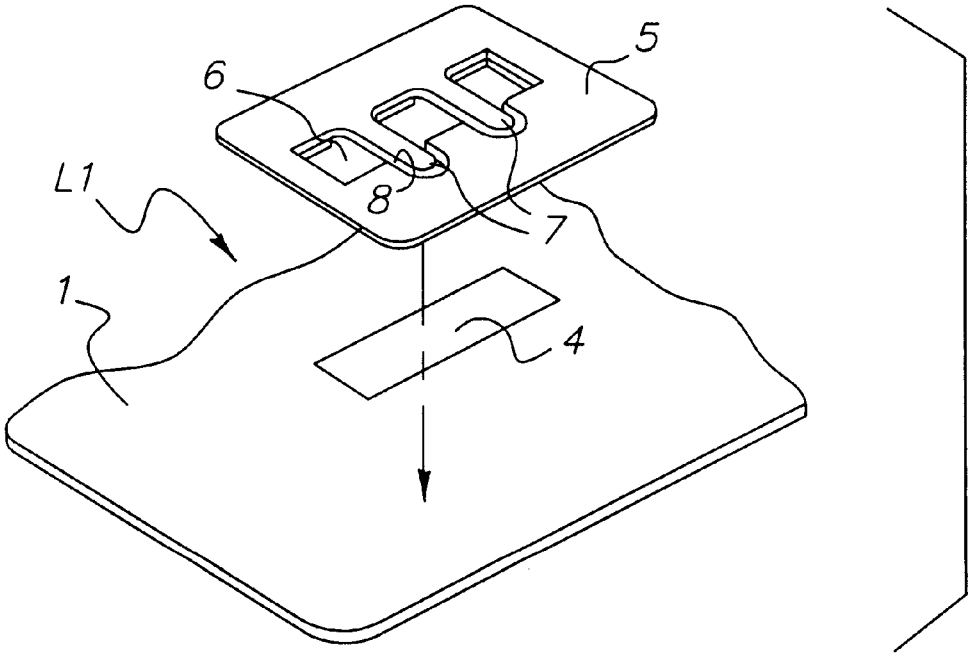
FIG. 37 is an exploded perspective view of part of a leader and a clip member.

At this point everything remains locked except for roller assembly 12, which then drives backward until the films 3 have been removed from the card (see FIGS. 18 and 33).

Figure 19:
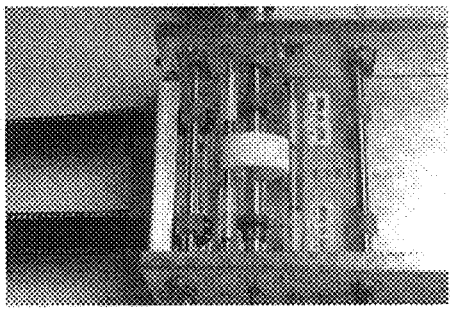
Figure 20:
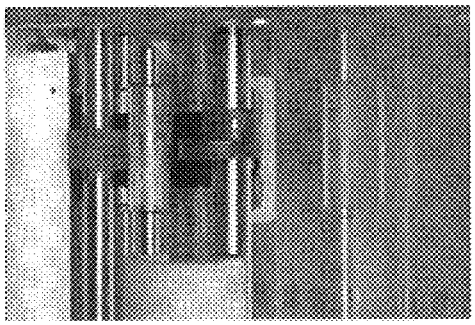
FIGS. 20–27 show a single side close up view of the film detach process.
Figure 21:
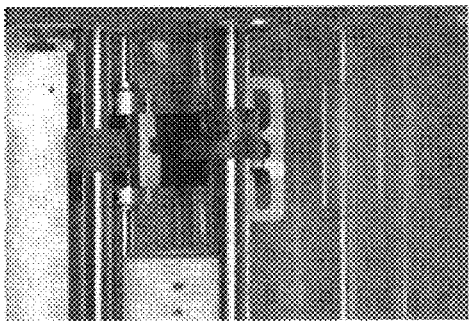
Figure 22:
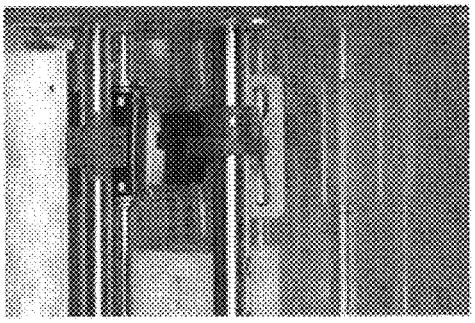
Figure 23:
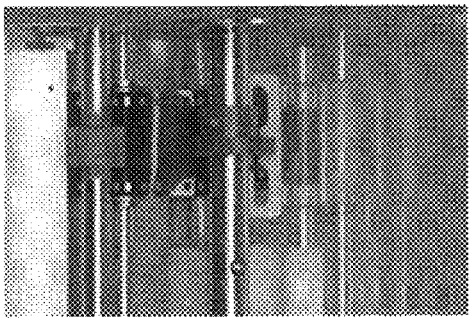
Figure 24:
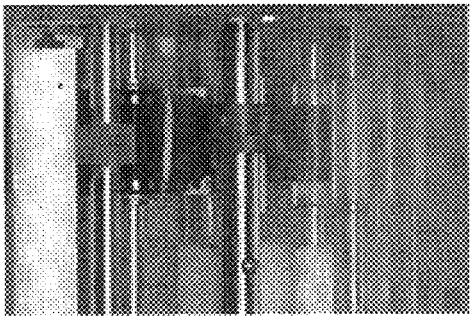
Figure 25:
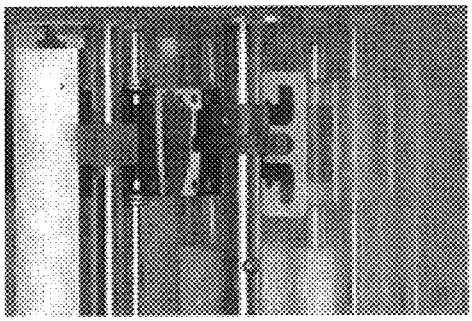
Figure 26:
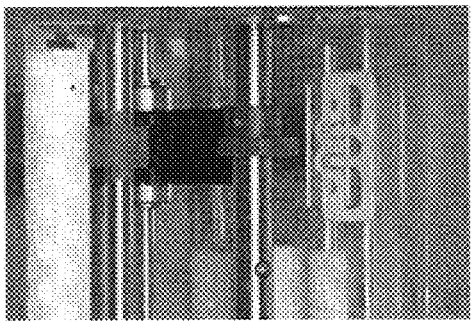
Figure 27:
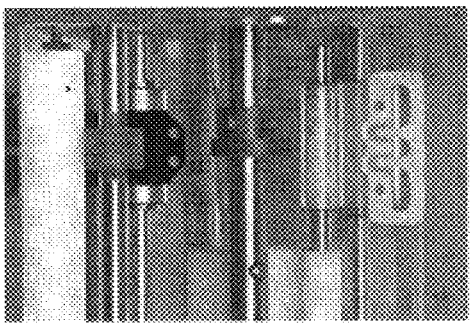

Roller assembly 14 drives the leader card 1 forward through the exit port 21 out of the detach unit (See FIG. 19).

Now the torque that has been applied by motor 32 is released, and the detach assembly 28 returns back to its starting position.

The single side close-up views of the detach process shown in FIGS. 20 through 27 correspond to the full view (double side) of the detach process shown in FIGS. 12 through 19. As such, FIGS. 20 through 27 may be understood by reference to the explanation given above of the procedure for the double sided case, except with reference to just one of the films.

The invention has been described with reference to a preferred embodiment. However, it will be appreciated that variations and modifications can be effected by a person of ordinary skill in the art without departing from the scope of the invention. For instance, while the leader card has been shown with a separate film clip 5 attached to and overlying the hole 4 in the leader body, it should be clear to the skilled person that other similar configurations are possible. For example, the protrusions 7 could be part of the leader body and formed integrally from a front edge of the hole 4, thereby eliminating the need for a separate clip that needed to be attached to the leader body.

PARTS LIST

1 leader
2 holes
3 film
4 holes
5 clip
6 window
7 protrusions
9 holes
10 detach mechanism
12 roller assembly A
14 roller assembly B
16 motor A
18 motor B
20 entry port
21 exit port
22 sensor A
24 sensor B
26 detach assembly
28 detach arm
30 cam
32 motor C
34 arc
36 roller assembly
38 pinch roller assembly

What is claimed is:

1. Apparatus for removing a film strip from a film leader card, said film strip having a film leader on a trailing end thereof with holes that engage one or more protrusions on a film clip on the film leader card, said apparatus comprising:

a feed section for holding the film leader card stationary in a first predetermined position with the film strip attached via protrusions to the film clip, said feed section having an entry port through which the film leader card is fully inserted in a forward direction with the film strip extending in a backward direction outward through the entry port;

means for forming a loop in the film that is folded underneath the film leader card in order to rotate the end of the film strip away from the film clip on the opposite side of the film leader card, thereby causing the film strip to detension from the protrusions;

a pinch roller assembly;

a detach mechanism for engaging the loop and extending it further under the film leader card toward, but not contacting, the pinch roller assembly, said detach mechanism including cams for further rotating the film strip until it is completely inverted and oriented in the forward direction, said cams holding the end of the film strip in place against the film leader card;

means for driving the film leader card in the backward direction toward the entry port until the film strip extends further through the film clip, at which point the film leader card is locked into a second predetermined stationary position;

means for further rotating said detach mechanism until the film strip is immovably engaged with the pinch roller assembly;

means for driving the film leader card forward away from the entry port until the film strip is disengaged from the film clip; and means for releasing the detach assembly from the pinch roller assembly so that the film strip may be removed from the film leader card through the entry port.

2. The apparatus as claimed in claim 1 wherein the means for forming a loop in the film that is folded under one side of the film leader card comprises a first roller assembly that drives the film strip forward against the stationary film leader card in order to form the loop and lift the trailing end of the film strip away from the film clip.

3. The apparatus as claimed in claim 1 wherein the means for holding the film leader card in place in a first predetermined position comprises a second roller assembly that locks the film leader card in place in the first predetermined position.

4. The apparatus as claimed in claim 3 wherein the roller assembly comprises a pair of rollers that captures the film leader card in a nip between the rollers.

5. The apparatus as claimed in claim 1 wherein the detach mechanism comprises a detach arm that rotates through an arc of less than 180 degrees from a position above the film leader card to a position below and under the film leader card.

6. A method for removing a film strip from a film leader card, said film strip having a film leader on a trailing end thereof with holes that engage one or more protrusions on a film clip on the film leader card, said method comprising the steps of:

feeding the film leader card through an entry port to a first predetermined stationary position with the film strip attached via the protrusions to the film clip, said film leader card being fully inserted in a forward direction with the film strip extending in a backward direction outward through the entry port;

forming a loop in the film that is folded underneath the film leader card to release and de-tension the film strip from the protrusions;

engaging the loop with a detach mechanism and extending the loop further under the film leader card while holding the trailing end of the film strip in place against the film leader card;

driving the film leader card in the backward direction toward the entry port until the film strip extends further through the film clip, at which point the film leader card is locked into a second predetermined stationary position;

further rotating said detach mechanism until the film strip is immovably engaged with a pinch roller assembly;

driving the film leader card forward away from the entry port until the film strip is disengaged from the film clip; and releasing the detach assembly from the pinch roller assembly so that the film strip may be removed from the film leader card through the entry port.

* * * * *